United States Patent [19]

Rijnders

[11] Patent Number: 4,884,383

[45] **Date of Patent: * Dec. 5, 1989**

[54] CEILING PANEL CARRIER ADAPTER MEMBER

[75] Inventor: Willem Rijnders, Papendrecht, Netherlands

[73] Assignee: Hunter Douglas International N.V., Curacao, Netherlands

[ * ] Notice: The portion of the term of this patent subsequent to Nov. 1, 2005 has been disclaimed.

[21] Appl. No.: 211,801

[22] Filed: Jun. 27, 1988

Related U.S. Application Data

[63] Continuation-in-part of Ser. No. 43,911, Apr. 29, 1987, Pat. No. 4,781,005.

[30] Foreign Application Priority Data

Apr. 28, 1987 [GB] United Kingdom ..... 8709964

[51] Int. Cl.[4] ..... E04B 5/52

[52] U.S. Cl. ..... 52/489; 52/484

[58] Field of Search ..... 52/484, 489, 665

[56] References Cited

U.S. PATENT DOCUMENTS

| | | |
|---|---|---|
| 3,313,075 | 4/1967 | Buchmeler . |
| 3,807,114 | 4/1974 | Ollinger . |
| 3,871,150 | 3/1975 | Murray et al. . |
| 4,041,668 | 8/1977 | Jahn et al. . |
| 4,157,000 | 6/1979 | Sutter . |
| 4,245,446 | 1/1981 | Judkins . |
| 4,270,327 | 6/1981 | Van Leeuwen . |
| 4,272,937 | 6/1981 | Brugman . |
| 4,361,996 | 12/1982 | Smith . |
| 4,448,006 | 5/1984 | Worley . |
| 4,483,116 | 11/1984 | Gailey . |
| 4,580,382 | 4/1986 | Judkins et al. . |

FOREIGN PATENT DOCUMENTS

| | | |
|---|---|---|
| 1860794 | 8/1962 | Fed. Rep. of Germany . |
| 1204801 | 11/1965 | Fed. Rep. of Germany . |
| 1582103 | 6/1969 | France . |
| 67231 | 6/1969 | German Democratic Rep. . |
| 658374 | 10/1951 | United Kingdom . |
| 925962 | 7/1958 | United Kingdom . |
| 854243 | 11/1960 | United Kingdom . |
| 994672 | 6/1965 | United Kingdom . |
| 1098613 | 1/1968 | United Kingdom . |

*Primary Examiner*—Carl D. Friedman

*Attorney, Agent, or Firm*—Pennie & Edmonds

[57] ABSTRACT

An adapter for use with a support grid for ceiling elements. In particular the adapter mounts on a horizontal bottom portion of an inverted T-shaped support. The adapter has a first flange forming a C-shaped clip. A plurality of such flanges are spaced along the adapter length so they do not interfere with cross support members. Holding flange portions support the ceiling elements. Additionally, further flange portions are provided to prevent transverse movement of the adapter relative to the support. The further flange portions are also spaced to prevent interference with cross supports.

11 Claims, 2 Drawing Sheets

CEILING PANEL CARRIER ADAPTER MEMBER

RELATED APPLICATIONS

This application is a continuation-in-part of U.S. patent application Ser. No. 043,911 filed Apr. 29, 1987 now U.S. Pat. No. 4,781,005.

FIELD OF THE INVENTION

The invention relates to a panel carrier and to a grid system for such panels.

BACKGROUND OF THE INVENTION

The prior art has provided various types of panel arrangements incorporating elongated spaced apart panels which are connected by various forms of panel carriers to a suitable structure. Many panel carriers presently on the market are unduly complex. In addition, most panel carriers presently in use are not suitable for use as replacements for existing carriers.

Carrier adapters are known which fit over a horizontal flange on an existing ceiling carrier or a support member having a horizontal flange. In particular U.S. Pat. No. 4,157,000 to Sutter shows a mounting device for a ceiling member. The device is an elongated adapter strip with tabs punched out of a horizontal portion of the adapter. The tabs secure decorative panels to inverted T-shaped ceiling grid support assemblies. The adapter has a C-shape which clips onto a horizontal flange of the existing grid.

The Sutter type clip however is arranged so the weight of the decorative panels causes the C-shape to open thus loosening the connection to the grid. Furthermore there is no positive prevention of the clip being moved off the grid. Further Sutter does not touch or give a solution for the issue of a possible interference of transverse grid supporting member with adapter(s) when the adapters are used with crosslinking grid supports. Such grid support assemblies are mostly used for several ceiling types to meet building requirements in respect of fire resistance and strength or as part of tile grid ceiling supporting the tile elements. This problem does not occur if a plurality of adapters are used that each have a length to fit in between subsequent transverse grid members such as known in U.S. Pat. No. 4,361,996 to Smith. Such construction requires a large number of short length adapters and makes installing cumbersome and laborious.

SUMMARY OF THE INVENTION

According to one aspect of the present invention there is provided an adapter member for attaching ceiling panels or elements to a support member of a ceiling construction. The construction includes a ceiling support grid including main support members and cross support members. The support members each include at least one laterally extending lower part, having a longitudinally extending lower surface and a lateral longitudinally extending free edge. The adapter members for connecting the elements to support members of the support grid include an elongated body portion for parallel engagement with the lower surface of the main support member, upwardly directed arm means bent over and extending above the body portion to define clip means for attaching the adapter member to the longitudinal free edge of the main support member and downwardly directed ceiling element attaching means, for engagement with the ceiling elements.

In accordance with the teachings of the present invention, the arm means include a plurality of first flange portions spaced along one side edge of the adapter member with the spacing between the first flange portions being correlated with the pitch and dimensions of the cross support members. In this way, the first flange portions will not coincide with said cross support members. The side edge of the adapter member body portion opposite the one side edge has upturned spaced further flange portions extending along the opposite longitudinal side of the support member. These flanges limit any transverse movement of the adapter member with respect to the support member. Also the spaces between the further flange portions are positioned so as to correlate with the pitch of the cross-support members at the relevant side and being dimensioned so as not to interfere with said cross-support members, if connected.

With such a construction of the adapter member, one can easily and safely fit the adapter member to the main support members of the ceiling support grid and use adapter members of considerable length including a length exceeding the length of the relevant support member. Careful positioning of the first flange portions so that they do not coincide with the cross supports enables one easily to fit the adapter without having to carry out any subsequent cutting operations which are both time consuming and give rise to the opportunity of damage to the adapter member.

The use of downwardly directed ceiling element attaching means for engaging with the ceiling elements allow the element to be attached to the ceiling support member in a way no interfering with the clip clamping action.

Preferably the elongate body portion has a width at least equal to the width of the lower surface of the support member to which the adapter member is to be attached. The further flange portions extending along the opposite longitudinal side of the support member from said arms, serve to limit or prevent any lateral movement of the adapter member with respect to the main support member.

The further flange portion can thereby readily stop the connector member accidentally being disengaged from the support member. This effect is further improved if the spacing between the further flange portion co-relates with the pitch of the cross support member connected to the relevant side of the support member, said further flange portions being dimensioned snugly to accommodate any such support member with little or no play in the longitudinal direction of the adapter member.

The number of further flange portions can be the same as the first flange portions but is preferably greater than the number of first flange portions, some of the further flange portions then being arranged immediately opposite the first flange portions and other further flange portions being arranged therebetween, as considered longitudinally of the body portion.

With this arrangement the adapter member can be adjusted lengthwise with respect to the support member to vary the position of the engaging means with respect to that support member and still be fixedly held in such selected position.

It will be appreciated that the adapter member of the present invention can be used with a wide variety of different support members provided that these support members each have at least one laterally extending lower part having a longitudinally extending lower surface and a lateral longitudinally extending free edge.

Preferably the support members with which the adapter of the present invention is to be used are of inverted T-cross section but an L-cross section, an I-cross section, a top hat cross section and many other suitable cross sections in which, in essence, a horizontal flange extends laterally to have a free edge may be employed.

Adaptation of the distribution of ceiling elements over the surface to be covered is therewith possible in a limited way. If the adapter member is for use with a ceiling construction in which the pitch of a series of standard United States (or European) inverted T-shape cross section cross members is one foot (or 30 cms), or a multiple thereof, the centre-on-centre distance of the spaces between the further flange portions is preferably two inches (or 5 cms) Furthermore, the centre-on-centre distance of the spaces between the first flange portions is preferably four inches (or 10 cms).

The spacing between the adjacent first flange portions is preferably substantially greater than the longitudinal dimensions of the first flange portions.

According to another aspect of the present invention there is provided a suspended ceiling comprising a support grid including main support members and cross support members of inverted T-shape, a plurality of ceiling elements and a plurality of adapter members according to the invention connecting the ceiling elements to the support members.

In order that the present invention may more readily be understood, the following description is given, merely by way of example, reference being made to the accompanying drawings, in which:

DESCRIPTION OF THE PREFERRED EMBODIMENT

Figure 1:
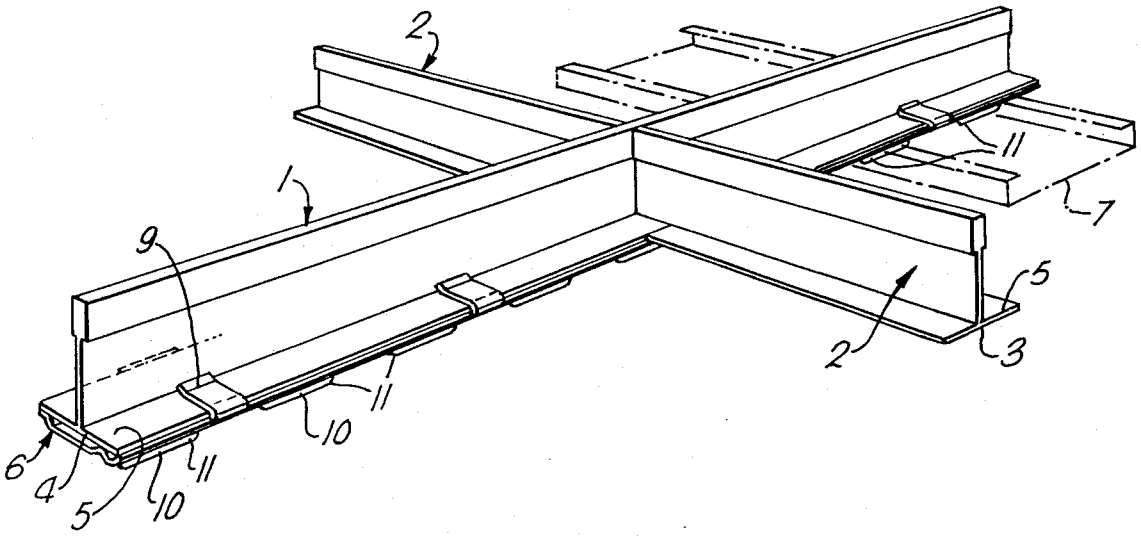
FIG. 1 a perspective view from one side of a portion of one embodiment of ceiling grid having an adapter of the invention in place.
Figure 3:
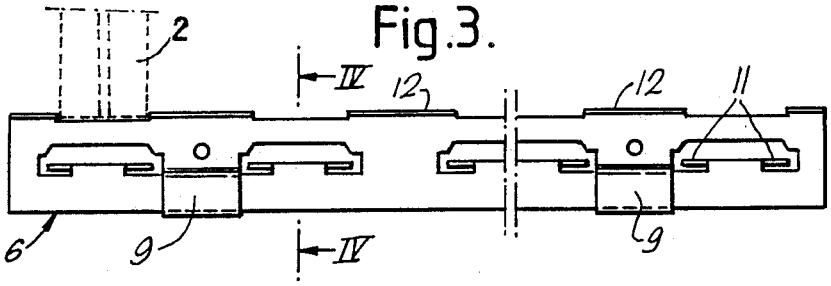
FIG. 3 is a top view of the adapter of FIG. 2.
Figure 4:
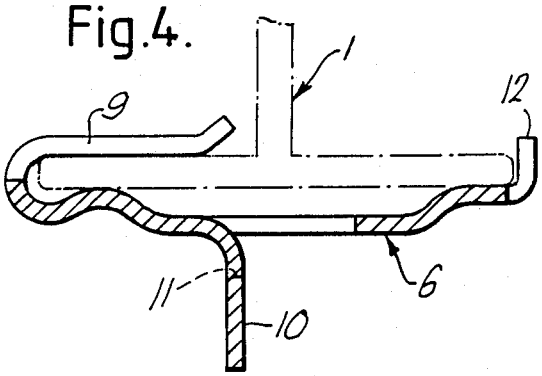
FIG. 4 shows the cross sectional configuration of the adapter along the lines IV—IV indicated in FIG. 3, shown in position on a support member.

Referring to FIG. 1 there is shown part of a support grid having support grid main support members 1 and cross-support members 2. Each of the support members has a bottom portion 3 with a longitudinally extending lower surface 4. The bottom portions also include a longitudinal sideways extending free edge 5. An adapter 6 is used to connect a plurality of ceiling elements 7 to the support grid and thereby support the ceiling elements 7. The adapter is shown in more detail in FIGS. 3, 4 and 5. The adapter 6 has an elongated body portion 8 which engages and is parallel to lower surface 4. The adapter has an upwardly directed arm means in the form of first flange portions 9 which bends over body portion 8 to define a clip means for attaching the adapter 6 to the free edge 5. The adapter 6 also has downwardly directed ceiling element attachment means in the form of second flange portions 10 punched out of laterally central body portion of the adapter 6 and spaced along the length thereof. Holding flange portions 10 are bent downwardly and have ceiling element engaging means 11 in the form of arms which engage the ceiling element. Alternatively they could engage only one edge of a ceiling element, with another of the engaging means engaging the other element-edge, dependable on the type of ceiling element and/or engaging means, as are common to the art.

The first flange portions 9 are spaced along the length of the adapter. The spaces are correlated with the pitch or location and dimension of the cross-support members 2 such that the first flange portions 9 do not interfere with the cross-support 2. This spacing may be advantageously chosen so the first flange portions are spaced by a dimension greater than the dimension of the first flange portions 9 itself in the longitudinal direction. This size may be chosen as four inches for a standard U.S. grid system or 10 cms for a standard European grid system, where the separation of adjacent cross-members is one foot or a multiple thereof, or another dimension, such as 30 cms appropriate to local practice can of course be selected.

Figure 2:
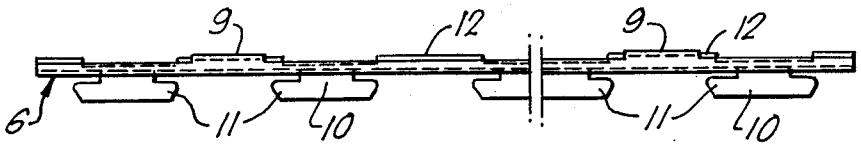
FIG. 2 is a side view of the adapter.

The adapter 6 is preferred to have a width at least equal to the width of bottom portion 3 of the support member. As shown in FIG. 2 the adapter 6 has further flange portions 12 which are on the side opposite the first flange portions. The further flange portion 12 is upturned and limits the transverse movement of the adapter relative to the support member. The further flange portions 12 are also spaced. Preferably this spacing is dimensioned so cross supports 2 are snugly accommodated in the spaces with little or no play in the longitudinal direction of the adapter 6 as shown in FIG. 2. The centre-on-centre spacing of the further flanges is two inches for standard U.S. grid system or 5 cms for a standard European grid system where the separation of adjacent cross members is one foot 30 cms respectively or a multiple thereof, or another appropriate dimension depending on local practice.

Preferably, the spacing of the first flange portions and further flange portions is such that a plurality of spaces between further flange portions occur along the length between two adjacent first flange portions. It is further preferred to have the transverse position of each first flange portion coincide with that of a further flange portion.

The adapter may be stiffened by providing a plurality of ridges 13 extending along its length.

The embodiments of the invention, in which an exclusive privilege or property is claimed, are defined as follows:

1. An adapter member for attaching ceiling panels to a support member of a ceiling construction which includes;

(a) a ceiling support grid including main support members and cross-support members, said support members each including at least one laterally extending lower part, having a longitudinally extending lower surface and a lateral longitudinally extending free edge;

(b) a plurality of ceiling elements; and (c) adapter members for connecting the elements to support members of the support grid; said adapter member including:

(1) opposite elongated side edges and a central elongated body portion for parallel engagement with the lower surface of the main support member, (2) upwardly directed arm means bent over and extending above the body portion to define clip means for attaching the adapter member to said longitudinal free edge of the main support member, (3) downwardly directed ceiling element attachment means for engagement with the ceiling elements, (4) said arm means including a plurality of first flange portions spaced along one side edge of the elongated adapter member, (5) the spacing between the first flange portions along said one side edge being correlated with the pitch and dimensions of the cross support members so that said first flange portions will not coincide with said cross support members, (6) upturned spaced further flange portions extending along the opposite longitudinal side edge of the support member from said one side edge for limiting any transverse movement of the adapter member with respect to the support member, and (7) the spaces between the further flange portions along said one side edge being positioned so as to correlate with the pitch of the cross-support members at the relevant side and being dimensioned so as not to interfere with said cross-support members, if connected.

2. An adapter member according to claim 1, wherein the spaces between the further flange portions are each dimensioned to snugly accommodate any such cross-support member with little play in the longitudinal direction of the adapter member.

3. An adapter member according to claim 1, wherein over the length of a space between two adjacent first flange portions on the one side of the adapter member there are a plurality of the spaces between further flange portion over the corresponding length at the other side of the adapter member.

4. An adapter member according to claim 1, wherein the spacing between adjacent first flange portions is substantially greater than the dimension of each of said flange portions in the longitudinal direction of the adapter member.

5. An adapter member according to claim 1 and for use with a ceiling construction in which the pitch of subsequent standard inverted T-shaped cross-support members is one foot or 30 cms or a multiple thereof, wherein the centre-on-centre distance of the spaces between the further flange portions is two inches or 5 cms.

6. An adapter member according to any one of claims 1 to 4 claim and for use with a ceiling construction in which the pitch of subsequent standard inverted T-shaped cross-support members is one foot or 30 cms or a multiple thereof, wherein the centre-on-centre distance of the first flange portions is four inches or 10 cms.

7. A suspended ceiling comprising a support grid including main support members and cross-support members of inverted T-shape, a plurality of ceiling elements and a plurality of adapter members for connecting the elements to support members of the support grid, the adapter members being in accordance with claim 6.

8. An adapter member according to claim 1, wherein the longitudinal position of each first flange portion coincides with that of one of said further flange portions.

9. An adapter member according to claim 1, wherein the downwardly directed ceiling elements attachment means include a plurality of holding flange portions spaced along the full length of the elongated adapter member at locations different from any of the first flange portions, and in that each of said holding flange portions have engaging means for holding at least one of the edges of a ceiling element.

10. The adapter member according to claim 9 wherein the downwardly directed ceiling elements attachment means are integral with and bent downwardly from the central body portion of the adapter member.

11. A suspended ceiling comprising a support grid including main support members and cross-support members of inverted T-shape, a plurality of ceiling elements and a plurality of adapter members for connecting the elements to support members of the support grid, the adapter members being in accordance with any one of claims 1–5 and 7–9.

* * * * *